US008708669B1

(12) United States Patent
Konopacki et al.

(10) Patent No.: US 8,708,669 B1
(45) Date of Patent: Apr. 29, 2014

(54) FUEL PUMPING SYSTEM

(75) Inventors: Jeffery M. Konopacki, Ripon, WI (US); Gregory D. Aykens, Menasha, WI (US); Daniel L. Kindschuh, Eldorado, WI (US)

(73) Assignee: Brunswick Corporation, Lake Forest, IL (US)

( * ) Notice: Subject to any disclaimer, the term of this patent is extended or adjusted under 35 U.S.C. 154(b) by 2230 days.

(21) Appl. No.: 11/705,215

(22) Filed: Feb. 12, 2007

(51) Int. Cl.
*F04B 35/01* (2006.01)

(52) U.S. Cl.
USPC ..... 417/364; 123/198 C

(58) Field of Classification Search
USPC ..... 417/359, 470, 471, 364, 553; 92/63; 123/198 C
See application file for complete search history.

(56) References Cited

U.S. PATENT DOCUMENTS

| | | | | | |
|---|---|---|---|---|---|
| 1,575,256 | A | | 3/1926 | Del Rio | |
| 4,140,444 | A | | 2/1979 | Allen | 418/48 |
| 4,273,520 | A | | 6/1981 | Sutliff et al. | 417/434 |
| 4,411,227 | A | * | 10/1983 | Feichtinger | 123/196 R |
| 4,541,788 | A | * | 9/1985 | Nomura et al. | 417/471 |
| 4,597,371 | A | | 7/1986 | Wissmann et al. | 123/495 |
| 4,701,082 | A | | 10/1987 | Fumey | 408/127 |
| 4,936,492 | A | | 6/1990 | Amiel et al. | 222/207 |
| 5,025,559 | A | | 6/1991 | McCullough | 30/276 |
| 5,085,564 | A | | 2/1992 | Naylor et al. | 418/48 |
| 5,370,507 | A | | 12/1994 | Dunn et al. | 417/389 |
| 5,374,168 | A | | 12/1994 | Kozawa et al. | 417/471 |
| 5,494,015 | A | | 2/1996 | Rynhart | 123/294 |
| 5,810,570 | A | | 9/1998 | Nguyen | 417/505 |
| 5,924,929 | A | | 7/1999 | Silver | 464/97 |
| 5,992,392 | A | * | 11/1999 | Saito | 123/508 |
| 5,996,472 | A | | 12/1999 | Nguyen et al. | 92/245 |
| 6,499,974 | B2 | | 12/2002 | Bach | 417/549 |
| 2005/0074349 | A1 | * | 4/2005 | Hool et al. | 417/553 |
| 2005/0112005 | A1 | * | 5/2005 | Yang | 417/470 |

* cited by examiner

*Primary Examiner* — Charles Freay
*Assistant Examiner* — Philip Stimpert
(74) *Attorney, Agent, or Firm* — Eric D. Bublitz

(57) ABSTRACT

A fuel pump uses an expanding spring to pressurize liquid fuel and cause it to flow through a pump outlet port. A cam and cam follower cause a piston to move in a direction opposite to the pumping stroke in order to transfer fluid from a first chamber to a second chamber within the body of the pump. During the spring actuated pumping stroke, liquid fuel is drawn from a fuel reservoir into the first chamber of the pump for later transfer to the second chamber during the return stroke caused by the cam mechanism. A flexible shaft connects the cam to mechanism to a source of motive power to allow the pump to be displaced from the source of motive power and away from certain potential sources of heat.

5 Claims, 8 Drawing Sheets

FUEL PUMPING SYSTEM

BACKGROUND OF THE INVENTION

1. Field of the Invention

The present invention is generally related to a mechanical fuel pump which can be coupled with a flexible shaft and, more particularly, to a mechanical fuel pump that pressurizes a flow of fuel through the exertion of a spring which causes a piston to move in an axial pumping direction.

2. Description of the Related Art

Those skilled in the art of fuel pumps are familiar with many different types of mechanical fuel pumps and, in particular, with mechanical fuel pumps that comprise a reciprocating piston contained within a generally cylindrical opening of a housing structure. Those skilled in the art of flexible shafts are familiar with many applications in which torque is transmitted through a flexible shaft which comprises a rotatable wire enclosed within a sheath or tube. Those skilled in the art of fuel systems for internal combustion engines are also familiar with the problem associated with vapor lock caused by excessive heat in the environment surrounding fuel handling components.

U.S. Pat. No. 1,575,256, which issued to Del Rio on Mar. 2, 1926, describes an attachment for a suction sweeper. It relates to an improvement in suction sweepers for driving a fan or its equivalent by means of which a powerful suction or partial vacuum is obtained and utilized in removing dust and like particles or fragments of matter from surfaces. It further extends the scope of usefulness of these types of apparatus by the utilization of the motor for a wide range of domestic purposes and without in any way or manner interfering with the usual and customary purpose.

U.S. Pat. No. 4,140,444, which issued to Allen on Feb. 20, 1979, describes a flexible shaft assembly for a progressing cavity pump. The pump components include a tubular stator with an interior helical surface and a hollow tubular orbital rotor within the stator operably connected to the shaft and having an exterior helical surface. The rotor and stator define therebetween sealed pumping cavities that advance axially as the rotor rotates and orbits within the stator. A coupling shaft flexes to accommodate orbital movement of the rotor during operation of the pump. The rotor is coupled to the rotor drive shaft by the flexible coupling shaft that extends through the hollow rotor.

U.S. Pat. No. 4,273,520, which issued to Sutliff et al. on Jun. 16, 1981, describes a deep well pump. A pump barrel open at its lower end is coupled at its upper end by a tubular adapter assembly to the lower end of a pump tubing string.

U.S. Pat. No. 4,597,371, which issued to Wissmann et al. on Jul. 1, 1986, describes a fuel injection apparatus for two stroke engines. It provides for the valve-controlled input of fuel into a pressure chamber of a housing and includes a spring loaded pump piston journaled for reciprocatory movement in a bore to supply the fuel. The pump piston is sealed by an annular seal. For fuel induction, the pump piston has a passageway opening into the pressure chamber and a valve seat. The valve seat of the pump piston operates with a substantially free-flying sealing body for opening and closing the valve.

U.S. Pat. No. 4,701,082, which issued to Fumey on Oct. 20, 1987, describes a multipurpose machining unit. In the multipurpose machining unit with pneumatic spindle feed, driving is performed, starting from a motor unit, directly or via a flexible shaft. An interchangeable gear set makes it possible to select the number of revolutions of the tool in accordance with its purpose.

U.S. Pat. No. 4,936,492, which issued to Amiel et al. on Jun. 26, 1990, describes a precompression pump. It comprises an open ended hollow body defining a pump chamber and an inlet orifice which communicates with a reservoir. The pump body has four side walls. A piston is mounted for reciprocal movement through a portion of the body and it extends through the upper end of the body. A ferrule is disposed above the body and defines an aperture through which the piston extends. A seal is disposed between the ferrule and the body, and the seal surrounds a portion of the piston. A spring is mounted in the body and the spring actively biases the piston toward the top of the body.

U.S. Pat. No. 5,025,559, which issued to McCullough on Jun. 25, 1991, describes a pneumatic control system for a meat trimming knife. A diaphragm mounted in the handle of the knife is compressed by the manual movement of a piston by an operator. The diaphragm is connected to a pressure switch which senses compression of the diaphragm and generates an electric control signal which actuates an electric clutch which couples the output shaft of the electric motor to the flexible cable for rotating the cutting blade.

U.S. Pat. No. 5,085,564, which issued to Naylor et al. on Feb. 4, 1992, describes a flexible drive shaft. The shaft for a helical gear pump has a rotor in which the drive shaft is formed with an enlarged head and is provided with a plastic material coating. The drive shaft is held onto the rotor by bolts passing through holes in the head and apertures in a cap.

U.S. Pat. No. 5,370,507, which issued to Dunn et al. on Dec. 6, 1994, describes a reciprocating chemical pump. All parts wetted by the fluid being pumped are made of flouroplastic material with the pumps having check valves that include floating ball members and O-rings positioned adjacent to the floating ball members. The retaining area in which the O-ring is received has a diameter that is at least about 0.01 inch larger than the diameter of the O-ring so as to allow the O-ring to move slightly.

U.S. Pat. No. 5,374,168, which issued to Kozawa et al. on Dec. 20, 1994, describes a reciprocating piston fluid pump. It comprises a pump driving section including a cam operated by an engine and a roller driven by the cam, the roller being provided at a lower end of a piston rod. It also comprises a piston provided at an upper portion of the piston rod and a pump chamber housing the piston and divided into a piston upper chamber and a piston lower chamber by the piston. The pump chamber includes a bearing opening at a central portion of the piston lower chamber through which the piston rod extends. A rod seal retainer portion is provided between the piston rod and the bearing opening of the pump chamber. A spring for urging the piston rod downwardly is provided. An oil passage for communicating the pump upper chamber of the pump lower chamber with the bearing opening is provided and the oil passage is provided on an oil seal member of the piston rod.

U.S. Pat. No. 5,494,015, which issued to Rynhart on Feb. 27, 1996, describes a fuel injector assembly. The injector assembly has a body with a bore having a gas passage at one end for communication with an engine combustion chamber. A piston is slidable in the bore. A fuel pump is mounted within the body having a plunger which is mounted on the piston for reciprocal pumping movement within a complimentary fuel pump cylinder for delivery of fuel to a nozzle assembly. The nozzle assembly is mounted on the piston and projects through the gas passage. The piston is urged downwardly by a timing spring so that a valve head on the nozzle assembly engages a valve seat until the pressure of combustion chamber gases acting on the outer portion of the nozzle is sufficient to overcome spring pressure and move the piston upwardly opening the passage to the piston so that the gases snap the piston upwardly due to the increased area exposed to the gases.

U.S. Pat. No. 5,810,570, which issued to Nguyen on Sep. 22, 1998, describes a super-low net positive suction head cryogenic reciprocating pump. The pump has a spring loaded intake valve made of magnetic material and a reciprocating piston having a permanent magnet at its head end. The intake valve is positioned such that when the piston is at or near the top of its stroke, the magnet will tend to pull the intake valve into an open position. The pump also preferably includes a mechanical spring energized seal at the upper end of the piston.

U.S. Pat. No. 5,996,472, which issued to Nguyen et al. on Dec. 7, 1999, describes a cryogenic reciprocating pump. The pump has a cylinder sleeve, head, intake valve, discharge valve, and a reciprocating piston including a mechanical spring energized seal having a generally U-shaped jacket and a helical spring in the bight of the U.

U.S. Pat. No. 5,924,929, which issued to Silver on Jul. 20, 1999, describes a flexible driveshaft and driveshaft and rotor assembly. The driveshaft, provided with a coating, is formed of titanium or similar metal. A relatively inexpensive metal flanged head portion is fastened to an end portion of the driveshaft and is bolted to the rotor. The structure enables a relatively short driveshaft to be used which is capable of transmitting heavy torque.

U.S. Pat. No. 6,499,974, which issued to Bach on Dec. 31, 2002, describes a piston pump. The pump has a piston axially movable against the force of the spring within an operating chamber connected via check valves to an operating cylinder and a hydraulic medium supply. A section of the piston that extends into the operating chamber has a reduced diameter extension which extends from a shoulder of the piston that delimits the operating chamber. The extension includes a thickened free end having a sealing surface facing the shoulder. A valve disk is located and guided on the extension of a gap between the shoulder and sealing surface and is capable of axially reciprocating movements thereon. The valve disk is provided with openings which provide a passageway for hydraulic medium from the operating chamber to a second check valve. The openings are blocked when the valve disk abuts the sealing surface.

The patents described above are hereby expressly incorporated by reference in the description of the present invention.

It would be significantly beneficial if a fuel pump could be configured so as to avoid a reduction of pressure of liquid fuel that is sufficient to cause the liquid fuel to vaporize or boil, particularly under elevated temperature conditions. It would also be significantly beneficial if a fuel pump could be developed which is simple in construction and yet able to consistently provide pressurized fuel at a generally constant pressure magnitude without undue variations in the pressure of the fuel being provided to an internal combustion engine. It would also be significantly beneficial if a fuel pump could be developed which could be mounted at a distance away from its source of motive power in order to allow the fuel pump to be spaced apart from heat sources that would otherwise exacerbate problems related to fuel vaporization and boiling.

SUMMARY OF THE INVENTION

A pump, made in accordance with a preferred embodiment of the present invention, comprises a piston having a central axis, a first surface and a second surface, a housing having an opening which is shaped to receive the piston, a seal disposed within the opening between the first and second surfaces and having an axial thickness which is less than the axial distance between the first and second surfaces, a motive device configured to cause the piston to move in a first direction within the opening and parallel to the central axis, a return device configured to cause the piston to move in a second direction within the opening and parallel to the central axis, whereby the second surface moves out of contact with the seal when the piston moves in the first direction and the first surface moves out of contact with the seal when the piston moves in the second direction, a fuel reservoir, and an outlet port which is connected in fluid communication with the opening, and an inlet port connected in fluid communication with the opening and configured to permit fuel to flow bidirectionally between the fuel reservoir and the opening.

In a particularly preferred embodiment of the present invention, the motive device is a cam disposed in sliding contact with a cam follower surface attached to the piston and the return device is a resilient member, such as a spring, which is configured to oppose movement of the piston in the first direction and to urge the piston to move in the second direction. The piston and the opening, in a preferred embodiment of the present invention, are shaped to define a first chamber and a second chamber when the piston is disposed within the opening. The seal is disposed between the first and second chambers. The inlet port is connected in fluid communication with the first chamber. Liquid within the first chamber flows into the second chamber when the piston moves in the first direction, liquid in the second chamber flows through the outlet port when the piston moves in the second direction, and liquid in the fuel reservoir flows into the first chamber through the inlet port when the piston moves in the second direction.

A preferred embodiment of the present invention also provides a liquid pumping system which comprises an internal combustion engine having a crankshaft, a power takeoff device connected in torque transmitting relation with the crankshaft, a pump having a stationary portion and a movable portion, and a flexible shaft attached between the power takeoff and the pump to transmit torque from the power takeoff device to move the movable portion of the pump relative to the stationary portion of the pump.

In a particularly preferred embodiment of the liquid pumping system of the present invention, the pump is a reciprocating pump and the movable portion is a piston. The pump is a fuel pump in a preferred embodiment and the power takeoff device comprises a driveshaft connected in torque transmitting relation between the crankshaft and the flexible shaft. In certain embodiments of the present invention, it can further comprise a gear system connected between the crankshaft and the driveshaft. The internal combustion engine can be a power head of an outboard motor. The pump of the liquid pumping system, in a preferred embodiment of the present invention, is a fuel pump of the type described above.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
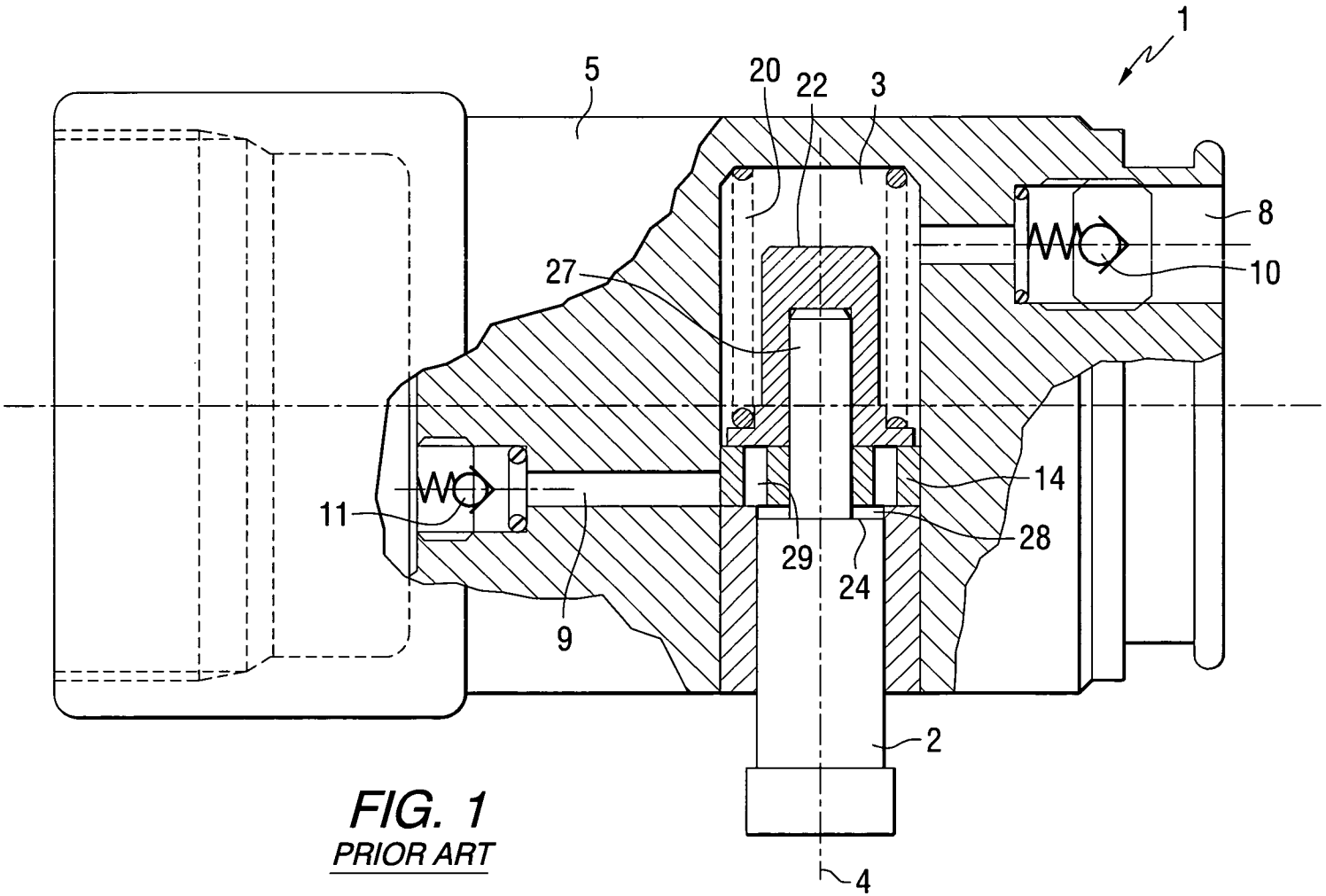
FIG. 1 PRIOR ART
FIG. 1 shows a fuel pump known to those skilled in the art.

Throughout the description of the preferred embodiment of the present invention, like components will be identified by like reference numerals.

FIG. 1 is an illustration of an exemplary pump which is generally similar to the pump described in U.S. Pat. No. 6,499,974. The fuel pump 1 has a piston 2 slidably disposed in a cylindrical opening 3 for reciprocal movement parallel to a central axis 4. The opening 3 is formed within a housing structure 5. An inlet conduit 8 and an outlet conduit 9 are connected in fluid communication with the opening 3. A first check valve 10 is disposed in the inlet conduit 8 and a second check valve 11 is disposed in the outlet conduit 9. A valve disk 14 is disposed around a portion of the piston 2.

With continued reference to FIG. 1, and in accordance with the description of the fuel pump provided in U.S. Pat. No. 6,499,974, its operation is as follows. Starting from the top dead center position, further rotation of a cam surface does not cause the piston 2 to be pushed upwards and the compression spring 20 can exert a force against the thickened end 22 of the piston 2. This spring 20 exerts a force which pushes the piston 2 toward its bottom position. The operating cylinder is decompressed and the check valve 11 closes to block flow of liquid through the outlet conduit 9. The inlet check valve 10 opens to allow hydraulic liquid to flow into the cylinder. The valve disk 14 lies against a shoulder 24. In progression of the stroke movement toward the bottom, the valve disk 14 strikes the top and remains stationary. In this position, connection to the second check valve 11 is closed by the valve disk 14. The piston 2 is moved by its thickened end 22 and the extension further into its bottom dead center position. The chamber 28 results between the valve disk 14 and the shoulder 24 of the piston 2 and is filled with hydraulic liquid through the openings 29.

With continued reference to FIG. 1, it should be noted that an upward stroke of the piston 2 causes fluid to flow through the outlet conduit 9 and check valve 11 while flow through the outlet conduit 8 is blocked by check valve 10. A downward movement of the piston 2, under the influence of spring 20, draws liquid through the inlet conduit 8. A more detailed operation of the pump shown in FIG. 1 is provided in U.S. Pat. No. 6,499,974.

Figure 2:
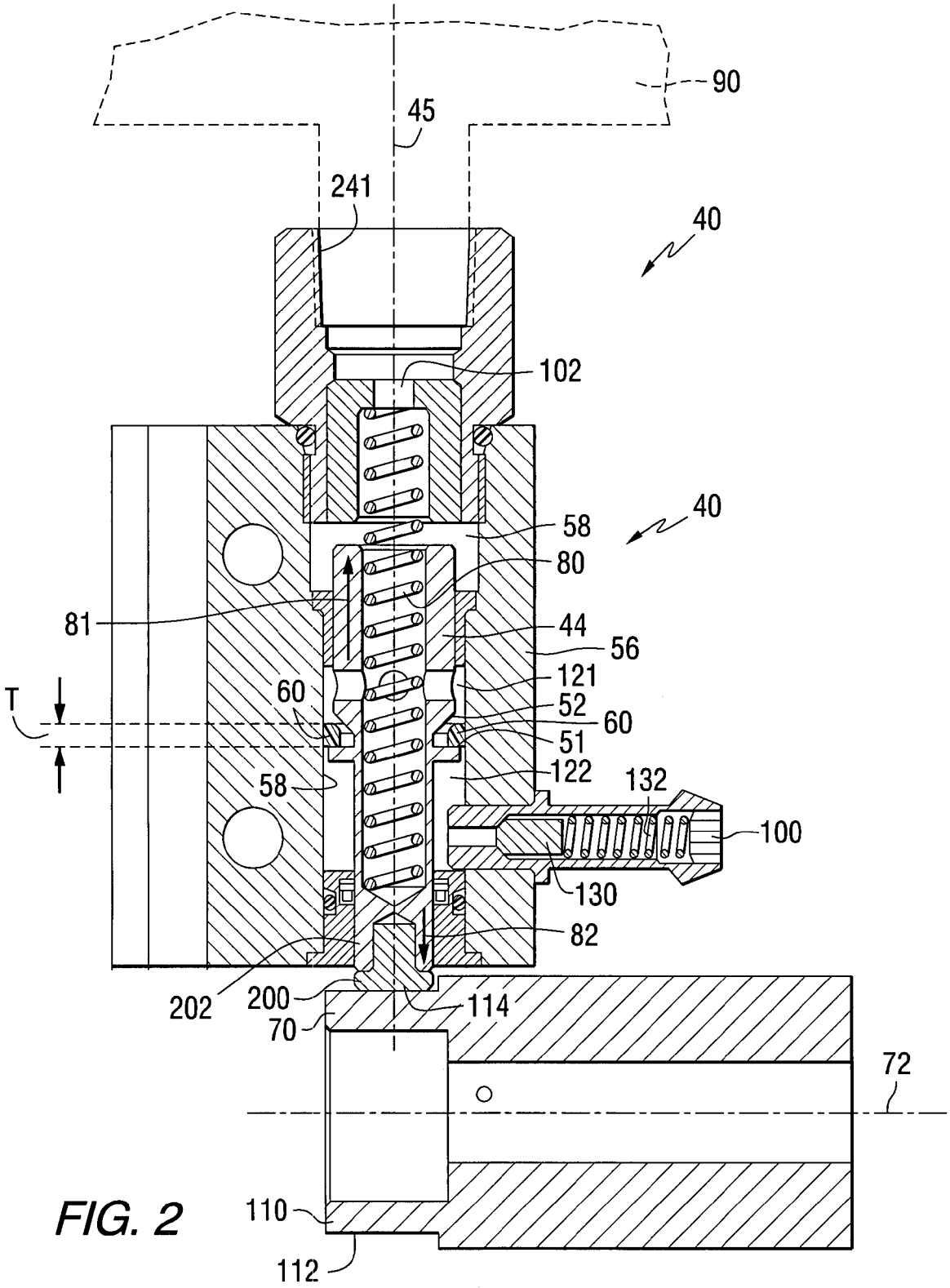
FIG. 2 shows a preferred embodiment of the present invention during a return stroke of its reciprocating piston.

FIG. 2 shows a preferred embodiment of the present invention. The fuel pump 40 comprises a piston 44 having a first surface 51 and a second surface 52. A housing 56 has an opening 58 which is shaped to receive the piston 44. A generally annular seal 60 is disposed within the opening 58 between the first and second surfaces, 51 and 52. The seal 60 has an axial thickness T which is less than the axial distance between the first and second surfaces, 51 and 52. A motive device 70, such as a cam which is rotatable about an axis of rotation 72, is configured to cause the piston 44 to move in a first direction 81 within the opening 58 and parallel to the central axis 45 of the piston 44. A return device 80, such as the spring illustrated in FIG. 2, is configured to cause the piston 44 to move in a second direction 82 within the opening 58. The first direction 81 is generally upward in FIG. 2 and the second direction 82 is generally downward in FIG. 2, as represented by their associated arrows. As a result of the thickness T of the seal 60 being less than the distance between the first and second surfaces, 51 and 52, the second surface 52 moves out of contact with the seal 60 when the piston 44 moves in the first direction 81 and the first surface 51 moves out of contact with the seal 60 when the piston 44 moves in the second direction 82.

With continued reference to FIG. 2, a fuel reservoir 90 is shown, by dashed lines, connected in fluid communication with the opening 58. The specific means for connecting the opening in fluid communication with the fuel reservoir 90 is not limiting to the present invention. An outlet port 100 is connected in fluid communication with the opening 58 and an inlet port 102 is connected in fluid communication with the opening 58 and configured to permit fuel to flow bidirectionally between the fuel reservoir 90 and the opening 58. The bidirectional flow of fluid through the inlet port 102 provides one of the advantages of the present invention. This advantage will be described in greater detail below.

With continued reference to FIG. 2, the motive device 70 in a preferred embodiment of the present invention is a cam 110 having a cam surface 112 that is disposed in sliding contact with a cam follower surface 114 attached to the piston 44. The return device 80 is a resilient member, such as a spring, which is configured to oppose movement of the piston 44 in the first direction 81 and to urge the piston 44 to move in the second direction 82. The piston 44 and the opening 58 are shaped to define a first chamber 121 and a second chamber 122 when the piston 44 is disposed within the opening 58. The seal 60 is disposed between the first and second chambers, 121 and 122. The inlet port 102 is connected in fluid communication with the first chamber 121. Liquid within the first chamber 121 flows into the second chamber 122 when the piston 44 moves in the first direction 81. The liquid in the second chamber 122 flows through the outlet port 100 when the piston 44 moves in the second direction 82. Liquid in the fuel reservoir 90 flows into the first chamber 121 through the inlet port 102 when the piston 44 moves in the second direction 82. It should be noted that a check valve is disposed within the outlet port 100. This check valve, in one embodiment of the present invention, comprises a movable plug 130 which is urged toward the left in FIG. 2 by a spring 132 to block fluid flow in a direction through the outlet port 100 toward the second chamber 122. When the pressure within the second chamber 122 is sufficient to overcome the force of the spring 132, fluid flows out of the second chamber 122 and through the outlet port 100. This defines a unidirectional flow through the outlet port 100 in a direction toward the right in FIG. 2. It should be noted and understood that the fluid flow through the inlet port 102 is bidirectional (i.e. upwardly or downwardly through the inlet port 102). Depending on conditions, this bidirectional flow can pass from the fuel reservoir 90 into the opening 58 or in the opposite direction. No restricting device, (e.g. a check valve) is provided in the inlet port 102 to inhibit or discourage fluid flow in either of these directions.

Figure 3:
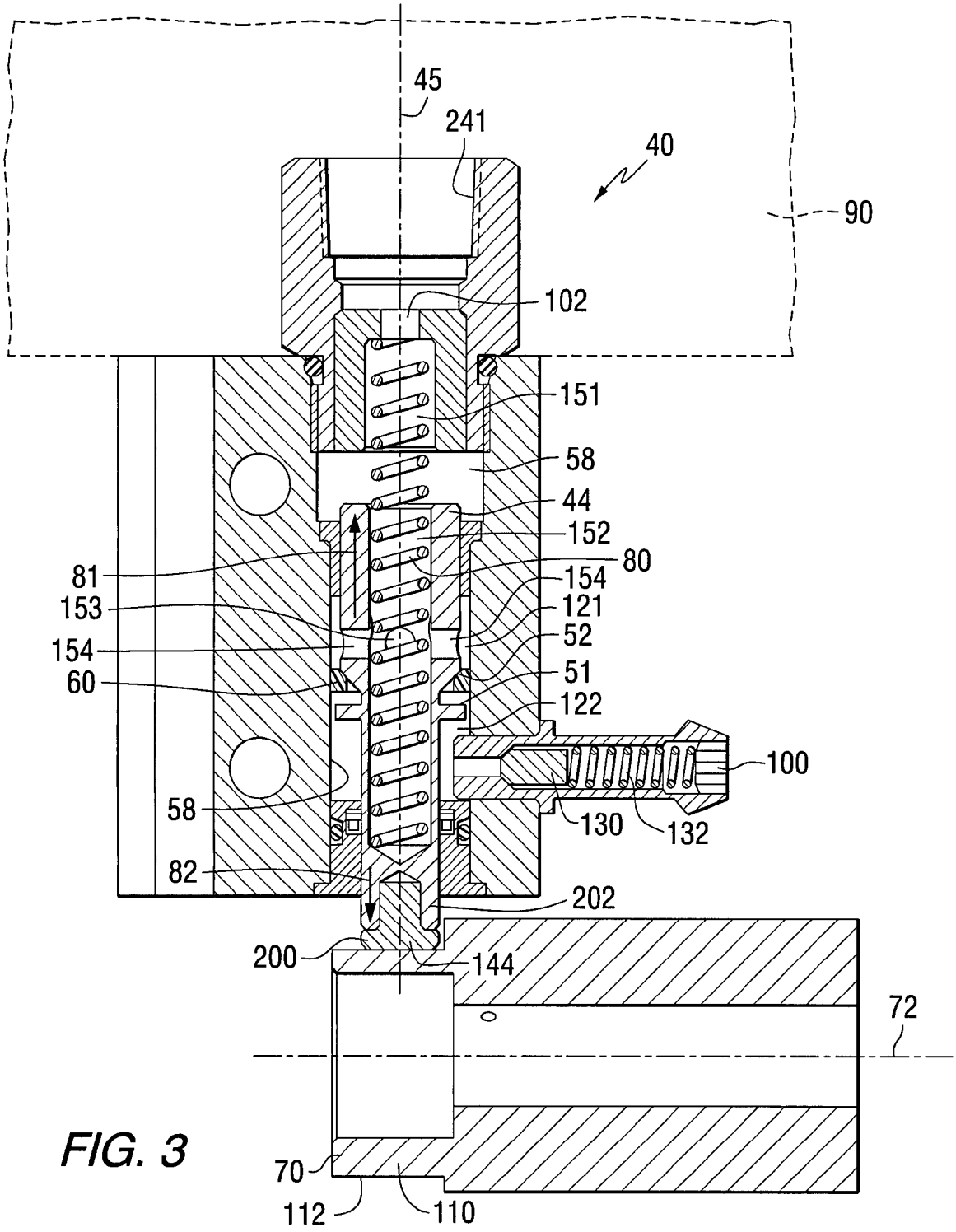
FIG. 3 shows the pump of the present invention during a pressurizing stroke under the influence of its spring.

FIG. 3 shows the pump which is illustrated in FIG. 2, but with the piston 44 moved downwardly in the second direction 82 under the force of the spring 80. This movement is allowed because the cam surface 112 of the cam 110, proximate the cam follower surface 144, moved downwardly as a result of the rotation of the cam about the axis of rotation 72. As will be described in greater detail below, the seal 60 then moves into contact with the second surface 52 of the piston 44. When the piston 44 was moving in the first direction 81, as illustrated in FIG. 2, the seal 60 was in contact with the first surface 51 of the piston 44. Movement in the second direction 82, as illustrated in FIG. 3, causes the piston to pressurize the fuel in the second chamber 122 and cause it to flow through the outlet port 100 when the pressure is sufficient to overcome the force provided by the spring 132 of the check valve and any pressure downstream of the check valve. This downward movement, in the second direction 82, also allows fuel to flow from the fuel reservoir 90 into the first chamber 121. It should be noted that the fuel reservoir 90 is connected to the fuel pump in a different manner in FIG. 3 than it is in FIG. 2. However, the fuel from the fuel reservoir 90 flows through the inlet port 102 and through the passages identified by reference numerals 151 and 152. It then flows through the opening identified by reference numeral 153 and through the conduits identified by reference numeral 154 into the first chamber 121. Therefore, as the downward movement of the piston 44 causes pressurized fluid to flow out of the outlet port 100, it also draws fluid from the reservoir 90 into the first chamber 121. This results in the liquid, such as liquid fuel, flowing into the first chamber 121.

In comparison, the upward stroke in the first direction 81 of the piston 44 causes fuel that was in the first chamber 121 to flow into the second chamber 122 as the piston 44 and the seal 60 move in an upward direction in FIG. 2. When the piston 44 moves upwardly in FIG. 2 in the first direction 81, fluid, such as liquid fuel, is transferred from the first chamber 121 to the second chamber 122 as it passes the seal 60 when the seal 60 is in contact with the first surface 51 and moving upwardly within the opening 58. When the piston 44 reaches the top of the stroke, the downward movement in the second direction 82 of the piston moves the second surface 52 into sealing contact with the seal 60 and pressurizes the fuel in the second chamber 122 as fuel is drawn into the first chamber 121 from the fuel reservoir. The pressurized fluid in the second chamber 122 then overcomes the check valve spring 132 and downstream pressure and flows out of the outlet port 100.

Figure 4:
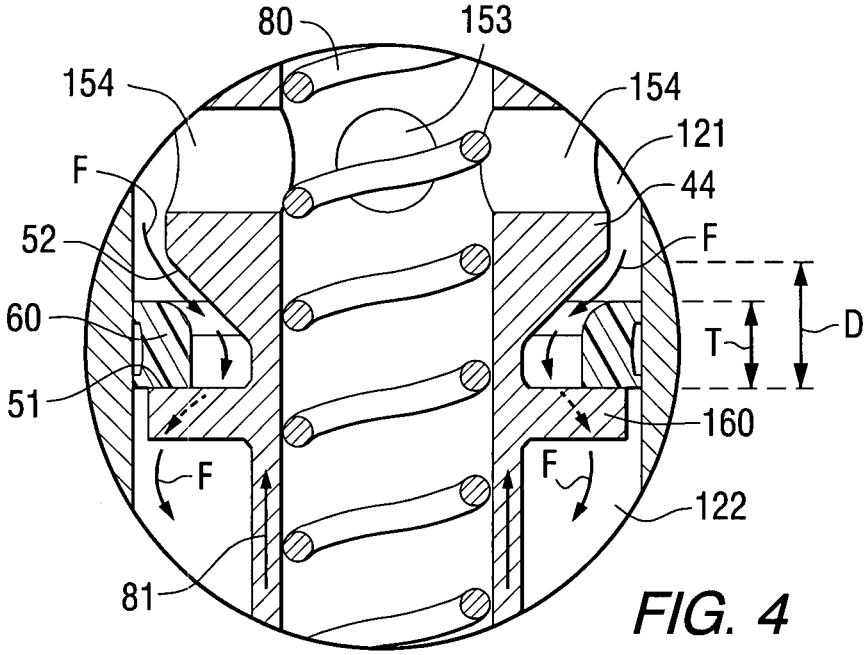
FIG. 4 is an enlarged section of the seal portion of FIG. 2.

FIG. 4 is an enlarged view of the portion of the fuel pump in the vicinity of the seal 60. The seal 60 is in contact with the first surface 51, as is also illustrated in FIG. 2, as a result of the upward movement of the piston 44 in the first direction 81. Although not shown specifically in FIG. 4, it should be understood that the radial extension 160 of the piston 44 is provided with a plurality of crenellations (shown in FIG. 7) which allow the flow of liquid, as represented by arrows F in FIG. 4, to flow from the first chamber 121 past the seal 60, through the crenellations of the radial extension 160, and into the second chamber 122. The fluid passage through the radial extension 160 can also be accomplished by providing axial holes therethrough.

Figure 5:
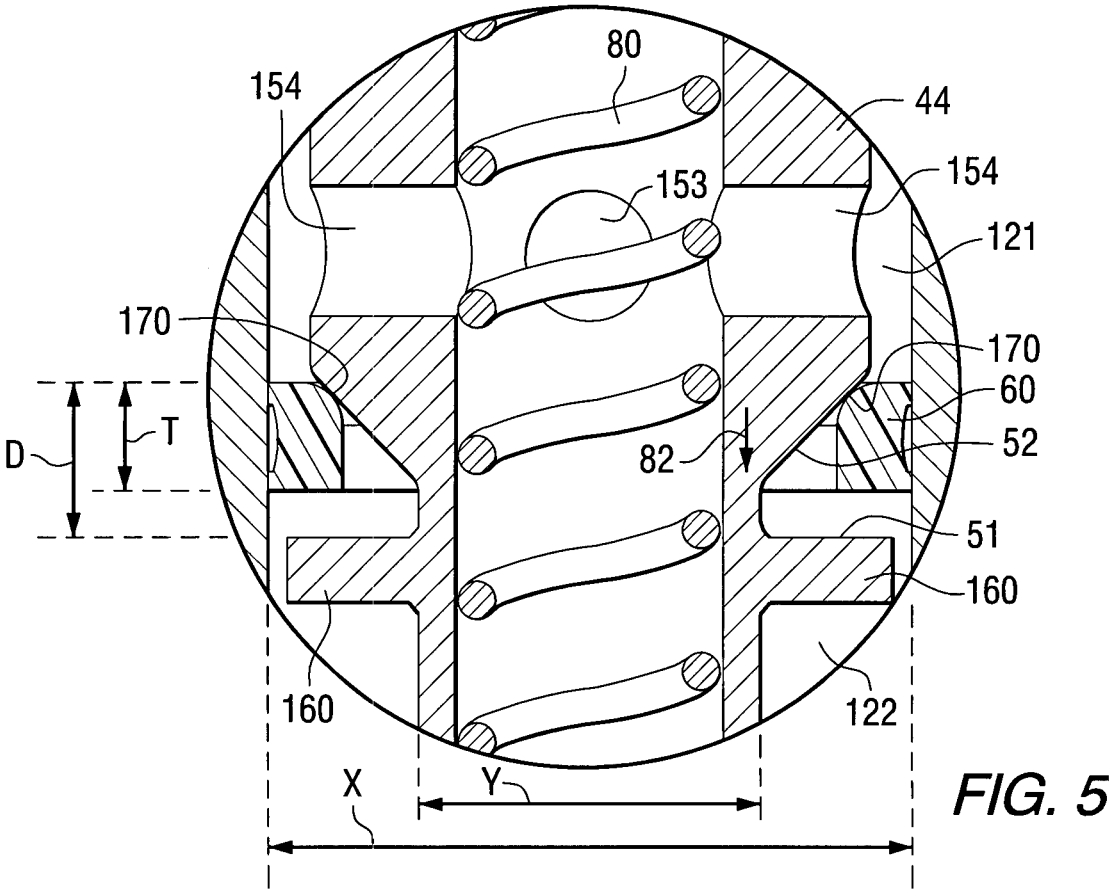
FIG. 5 shows an enlarged view of the seal portion of FIG. 3.

FIG. 5 is an enlarged view of the portion of the pump proximate the seal 60 showing the relationship between the seal 60 and the second surface 52 when the piston 44 moves in the second direction 82 which is downward in FIG. 5. The second surface 52 of the piston 44 moves into contact with the seal 60, at point 170, and the seal 60 moves downwardly in synchrony with the piston 44. This sealing effect between the seal 60 and the second surface 52 pressurizes the fluid in the second chamber 122 as described above.

With reference to FIGS. 4 and 5, it can be seen that the axial thickness T of the seal 60 is less than the axial dimension D between the first and second surfaces, 51 and 52. When the seal 60 is in contact with the second surface 52, at point 170, as shown in FIG. 5, it provides a seal between the first and second chambers, 121 and 122. When the seal 60 is moved out of contact with the second surface 52 and into contact with the first surface 51, fluid is allowed to pass from the first chamber 121 into the second chamber 122 because it flows between the seal 60 and the second surface 52 and through the crenellations formed in the radial protrusion 160.

Figure 6:
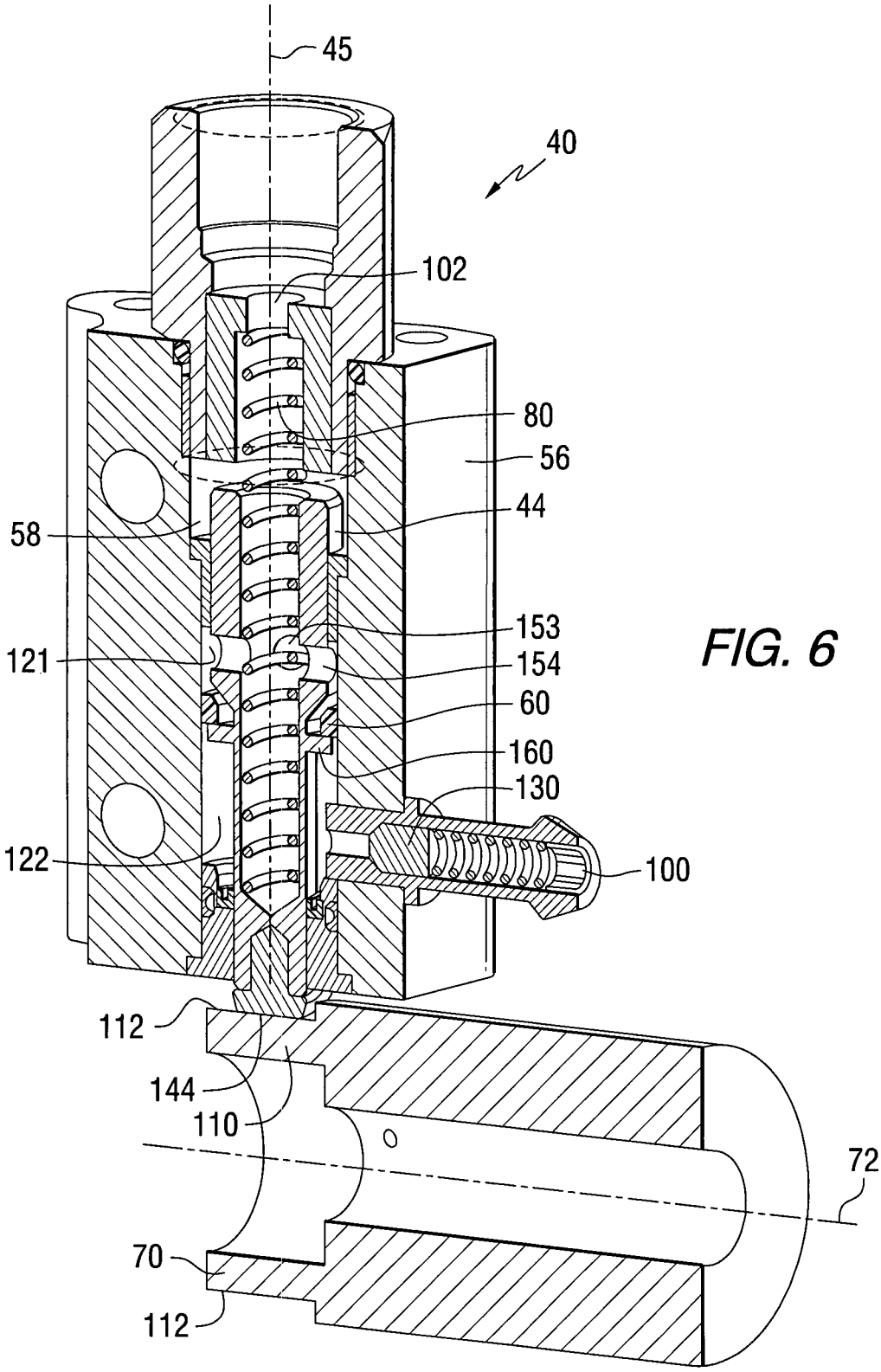
FIG. 6 is a sectioned isometric view of a pump made in accordance with a preferred embodiment of the present invention.

FIG. 6 is an isometric section view of a fuel pump made in accordance with a preferred embodiment of the present invention. The piston 44 is shown disposed within the opening 58 of the housing 56. The seal 60 is disposed between the first and second surfaces of the piston 44 to define a first chamber 121 and a second chamber 122. Rotation of the cam structure 70 causes the piston 44 to move upwardly against the force of the spring 80. During the upward movement of the piston 44, liquid fuel flows from the first chamber 121 into the second chamber 122, past the seal, and into the first chamber 121 from the fuel reservoir described above in conjunction with FIG. 2. During the downward stroke of the piston 44 under the force of the spring 80, the seal 60 forms a sealing relationship with the second surface 52 to pressurize the fuel in the second chamber 122 and cause it to flow through the outlet port 100.

Figure 7:
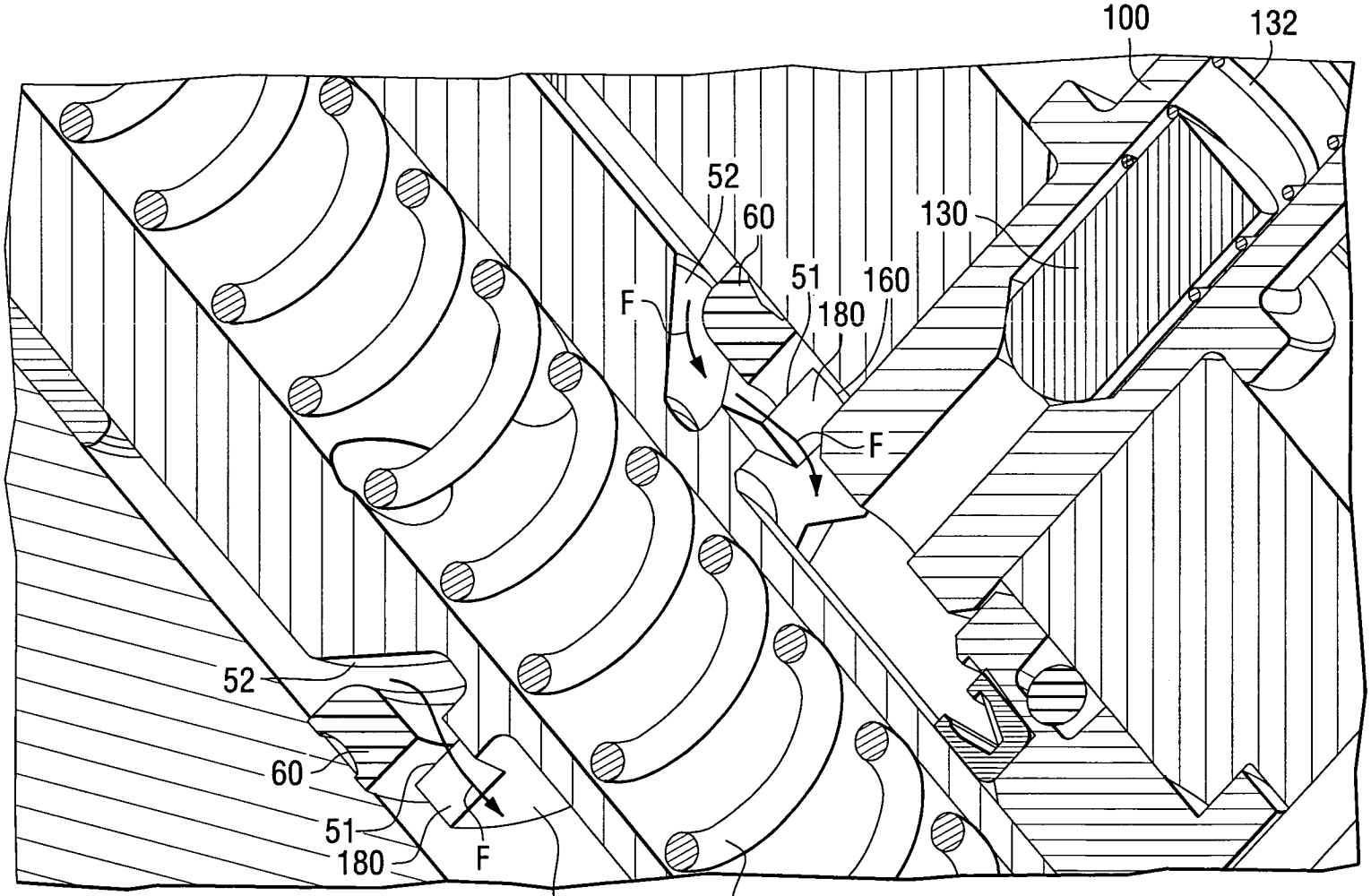
FIG. 7 is an enlarged view of the seal portion of FIG. 6.

FIG. 7 is an enlarged view of a portion of the pump in the vicinity of the seal 60. The crenellations 180 formed in the radial extension 160 are shown in FIG. 7. These crenellations 180 allow the flow F of fuel past the radial extension 160 after it flows between the seal 60 and the second surface 52 as described above in conjunction with FIG. 4.

Figure 8:
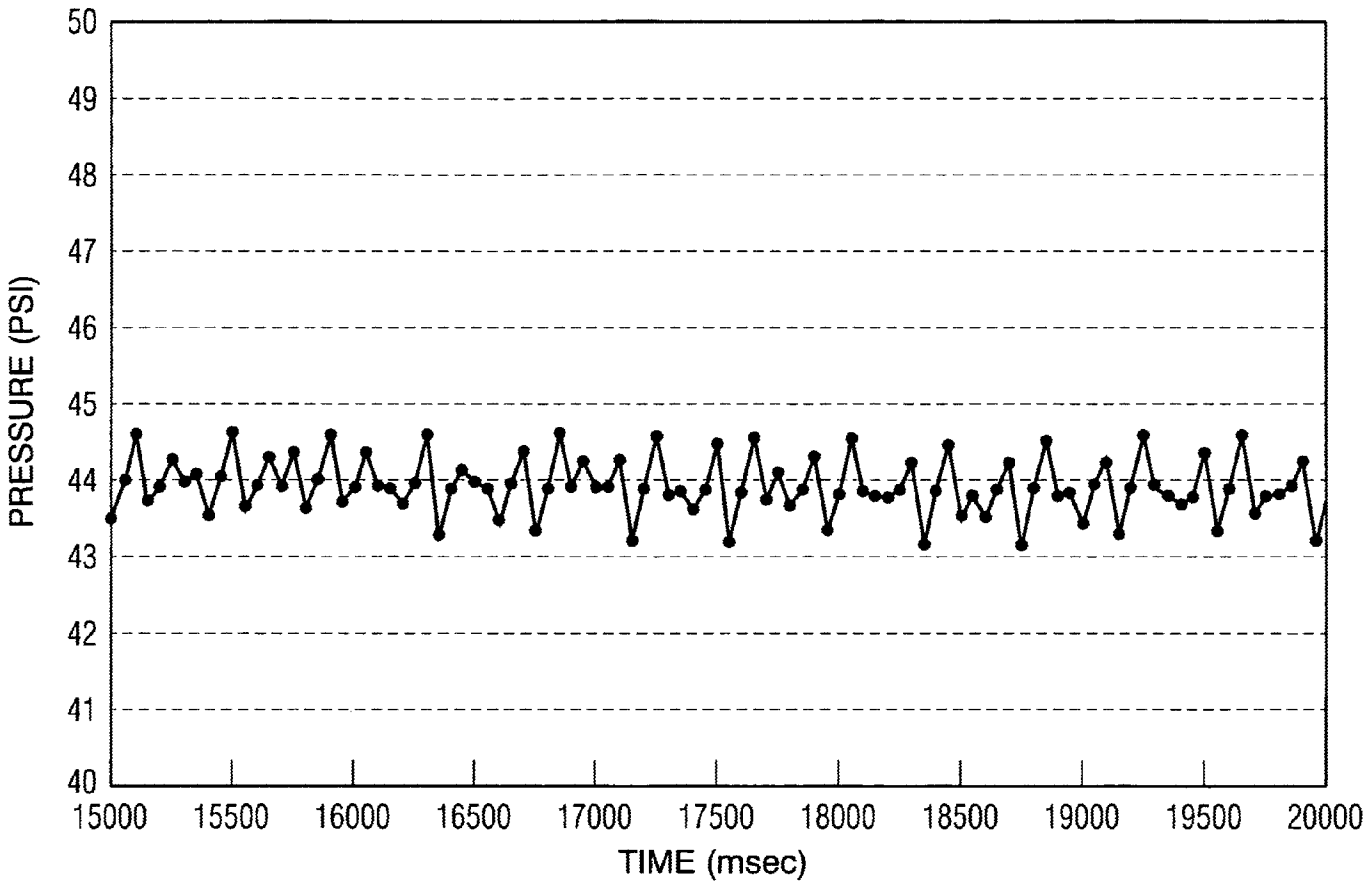
FIG. 8 is a graphical representation of the variability of pressure magnitude over time resulting from the use of the present invention.

FIG. 8 is a graphical representation of the variation of liquid pressure within the outlet port 100 over a period of time. The horizontal axis in FIG. 8 identifies the time period, in milliseconds, and the vertical axis identifies the fluid pressure in pounds per square inch (PSI).

With reference to FIGS. 5 and 8, it should be understood that the pressure in the second chamber 122 results from the downward force of the spring 80 acting on the annular area which is defined as the difference between the area associated with diameter X in FIG. 5 and the area associated with the diameter Y in FIG. 5. That annular area, under the exertion of the force of the spring 80 produces the pressure in the second chamber 122. Since the spring constant of the spring 80 is a relatively unchanging parameter, the force provided by the spring 80 is a function of its compression between a point of maximum extension to a point of maximum compression which is a relatively slight difference in length. FIG. 2 shows the length of the spring 80 at its condition of maximum compression and FIG. 3 shows the length of the spring 80 when it is fully extended. This difference in spring length, multiplied by the spring constant, determines the force exerted on the area difference between the circles of diameters X and Y in FIG. 5. That pressure therefore varies only slightly between the spring's minimum and maximum lengths. This consistency of pressure is graphically represented in FIG. 8. Over the five seconds represented in FIG. 8, the pressure was consistently between 43 PSI and 45 PSI. This minimal variation is well within the operating parameters of most fuel delivery systems and is a significant improvement over fuel pumps known to those skilled in the art of marine fuel systems.

In certain applications of fuel pumps, such as under the cowl of an outboard motor, the fuel pump is typically located in a region near a source of heat. If the fuel pump temperature is elevated above certain limits, the liquid fuel can vaporize or boil and create significant vapor lock problems. Even though the pump of the present invention provides a significant improvement in minimizing the decrease in pressure experienced by liquid fuel, the placement of the fuel pump in an area of excessively high temperatures can decrease this advantage under certain circumstances. It may therefore be beneficial if the pump can be displaced from its source of motive power, such as an engine crankshaft, to place the pump in a more advantageous location which is displaced from its connection to that source of motive power.

Figure 9:
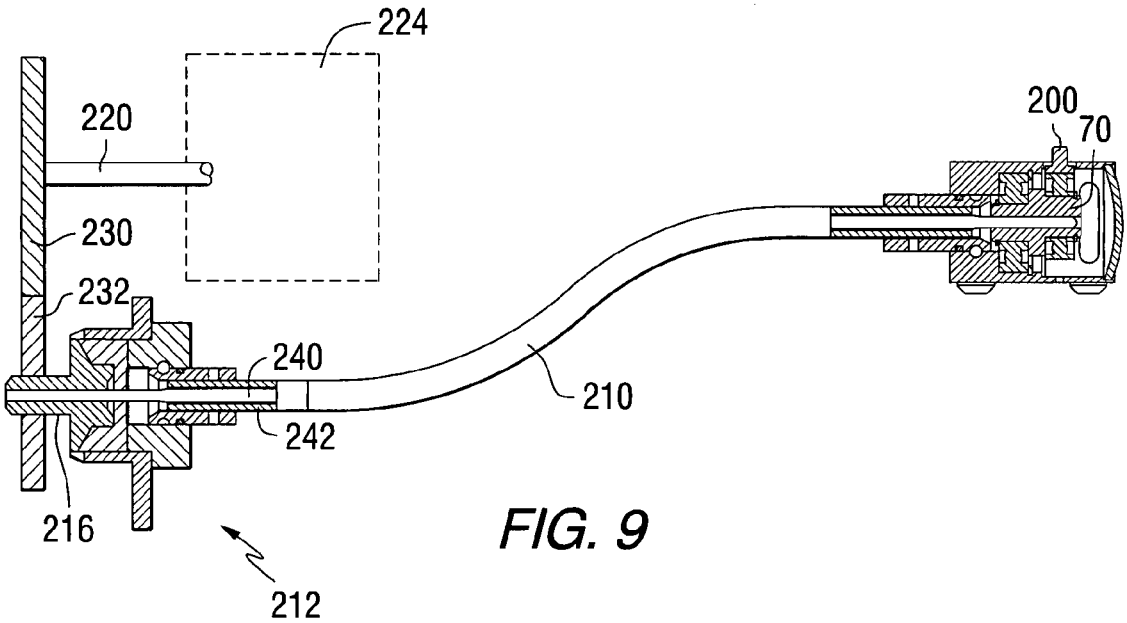
FIG. 9 shows the use of a flexible shaft in conjunction with the present invention.

In FIGS. 2 and 3, a cam member 70 was shown supported for rotation about an axis of rotation 72. The cam member 70 is illustrated in FIGS. 2 and 3 as having a cam surface 112 which is sliding contact relation with a cam follower surface 144 of a cam follower 200. The cam follower 200 is shaped to be attached to one end 202 of the piston 44. For purposes of simplicity of illustration, the fuel pump 40 of the present invention is not shown in FIG. 9, but it should be understood that cam follower 200 is intended to be attached to the piston 44 in the manner illustrated in FIGS. 2 and 3. The cam member 70 shown in FIG. 9 is connected in torque transmitting relation with a flexible shaft 210 which, in turn, is connected in torque transmitting relation with a power takeoff device 212. The power takeoff device 212 comprises a driveshaft 216 which is connected in torque transmitting relation between a crankshaft 220 of an internal combustion engine 224, which, in particular embodiments, is a power head of an outboard motor. For purposes of exemplary illustration, two gears are shown connected between the crankshaft 220 and the driveshaft 216 of the power takeoff device 212. These two gears are identified by reference numerals 230 and 232. It should be understood that the particular manner by which the torque transmitting connection is provided between the crankshaft 220 and the driveshaft 216 is not limiting to the present invention. Gears, belts, drive chains or any other means for providing this torque transmitting connection should be considered within the scope of the present invention. In addition, it should be realized that in the exemplary illustration in FIG. 9, the engine 224, crankshaft 220, and gears 230 and 232 are not drawn to size and are intended to merely show the functional relationship between these devices. The driveshaft 216 is attached to an end of the internal wire 240 which is disposed within a sheath 242, or tube, in a manner generally known to those skilled in the art of flexible shafts. This allows torque to be transmitted between the driveshaft 216 and the cam device 70 to cause the cam device 70 to rotate about its axis of rotation (reference numeral 72 in FIGS. 2, 3 and 6). The cam follower 200 and its associated components proximate the cam device 70 can be located at a region where the temperature is lower than the temperature near the internal combustion engine 224. In addition, the fuel pump 40 and the cam mechanism can be located near or within a fuel vapor separator. The use of the flexible shaft 210 allows this freedom of location of the fuel pump away from the source of motive power, such as the internal combustion engine 224.

Figure 10:
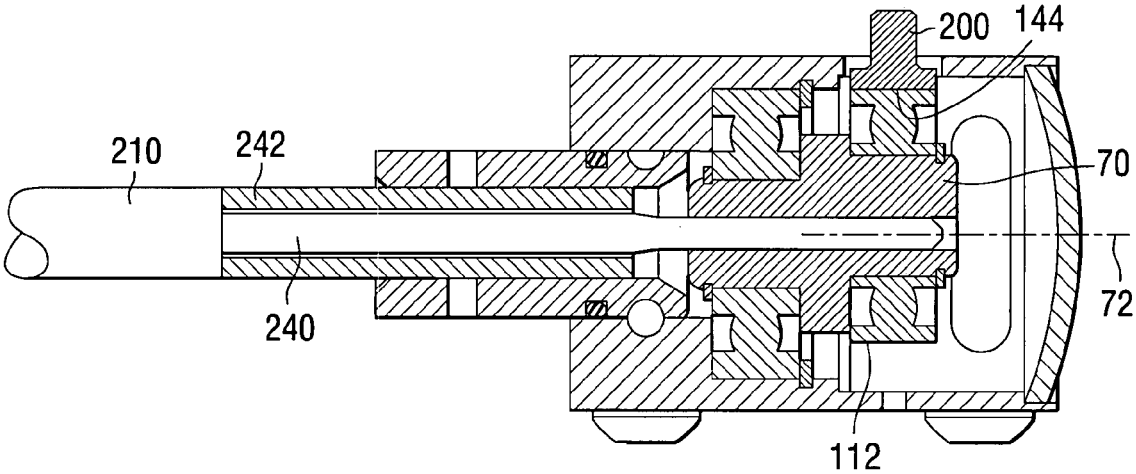
FIG. 10 is an enlarged view of the cam mechanism of the present invention connected to a flexible shaft.

FIG. 10 shows the cam system in an enlarged view. The cam device 70 is rotatable about the axis of rotation 72 to cause the cam surface 112 to rotate about the axis of rotation 72 while in sliding association with a cam follower surface 144 of the cam follower 200 which is intended to be attached to the piston 44 as illustrated in FIGS. 2, 3 and 6. The flexible shaft 210, with its rotatable wire 240 within the sheath 242, allows the cam mechanism to be displaced from the source of motive power. In addition, it allows the axis of rotation 72 to be located in non-coaxial and non-concentric relation with the axis of rotation of the driveshaft 216.

With continued reference to FIGS. 2-10, it should be understood that a typical application of the present invention would provide pressurized fuel in the second chamber 122 at a pressure of approximately 43 PSI. This intended pressure magnitude is representative of a fuel injection system, but not required in all systems. The important characteristic of the fuel delivery system is that it should provide a fuel pressure that is consistent without significant variability, as represented in the graphical illustration of FIG. 8. In the present invention, this pressure is controllable to a very narrow band of tolerance because it is directly related to the spring constant of the spring 80 acting against the liquid fuel in the second chamber 122 with a known area that is equivalent to the difference in areas of the circular regions identified by reference numerals X and Y in FIG. 5. Since the spring is used in the pressurizing motion in the second direction 82, this consistency is achievable. With particular reference to the known pump shown in FIG. 1, it should be understood that the existence of the check valve 10 in the inlet conduit 8 requires that the pressure within opening 3 be reduced sufficiently to create a pressure differential between the liquid on the right side of the check valve 10 in FIG. 1 and the liquid within the opening 3 on the left side of the check valve 10. This required pressure differential lowers the pressure within the opening 3 to cause flow through the check valve 10. This reduction in pressure can, under certain thermal conditions, result in the vaporization or boiling of the liquid fuel as it flows through the inlet conduit 8 into opening 3 in the pump illustrated in FIG. 1. The existence of the check valve 10 in the inlet conduit 8 defines a significant difference between the pump shown in FIG. 1, and described in U.S. Pat. No. 6,499,974, and the pump of the present invention.

During the pumping stroke of the present invention, as illustrated in FIG. 3, the fuel is permitted to flow from a fuel reservoir, through the inlet port 102, and into the first chamber 121 without having to overcome the spring force of a check valve in the manner described above in conjunction with the check valve 10 in the inlet passage 8 of the pump shown in FIG. 1. Since the inlet port 102 has no check valve within it, fluid is free to flow through the inlet port 102 in a bidirectional manner, depending on the relative pressures in the fuel reservoir and in the first chamber 121. As the piston 44 moves downward in FIG. 3 in the second direction 82, the fuel naturally flows from the fuel reservoir into the first chamber 121. This flow can occur as a result of gravity, if the fuel reservoir is above the pump 40, or as a result of a minor reduction in the pressure within the first cavity 121 due solely to the enlargement of the first cavity volume above the seal 60. In a preferred embodiment of the present invention, the fuel pump can be located below the fuel reservoir to further gain advantage from these characteristics. However, the primary reason for this significant advantage is the absence of a check valve in the inlet port 102 which has been described herein as the reason for the bidirectional flow of fluid through the inlet port 102 which results from this lack of any obstruction within it. At the upper portion of the pump shown in FIG. 2, a female thread 241 is provided to attach a fuel conduit to the pump. Alternatively, the upper portion of the pump can be disposed entirely within a fuel reservoir 90 as shown in FIG. 3. The particular manner in which the pump is attached to the fuel reservoir 90 is not limiting to the present invention.

Because the force provided by the spring 80 is balanced by the force resulting from the pressure within the second chamber 122 acting against the difference in areas associated with diameters X and Y, an equilibrium between these two opposing forces will result. If no fuel is drawn through the outlet port 100 (e.g. by a fuel injector), the pressure of the fuel in the second chamber 122 will create a force against the piston 44 which is balanced by the force provided by the spring 80. As a result, it is possible that the piston will not move in the second direction even when the cam surface 112 moves away from the cam follower surface 114. Under these conditions, if a slight movement in the second direction occurs, the next revolution of the cam 70 will push the piston 44 in the first direction and some additional fuel may move from the first chamber 121 to the second chamber 122. However, as the cam surface 112 moves away from the cam follower surface 114, the spring 80 will not always cause the piston 44 to move in the second direction 82 to its bottom position because that movement is resisted by the pressure within the second chamber. This force balancing, between the force caused by the pressure in the second chamber 122 and the force provided by the spring, distinguishes the present invention from prior art fuel pumps which use a cam force to create the pumping action; The present invention uses a spring force to create the pumping of the pressurized fuel and uses the cam force to return the piston 44 back to its upward position illustrated in the figures. During this return movement, in the first direction 81, pumping does not occur and the only substantial effect on the fuel is to cause the flow from the first chamber 121 into the second chamber 122, as described above.

With continued reference to FIGS. 2-10, the present invention has also been described in terms of how a flexible shaft 210 can be used to allow the pump 40 to be located at a position displaced from the source of motive power, such as the engine. This flexible shaft 210 allows the axis of rotation 72 of the cam device to be located in non-concentric and non-coaxial relation with the axis of rotation of the driveshaft 216 of the power takeoff device 212.

The primary advantage of the pump of the present invention is that it provides a relatively constant magnitude of pressure of the fuel provided at its outlet port 100. This relatively constant pressure is a result of the use of the spring during its pressurizing stroke, rather than having a pressurizing stroke driven by the cam 70 which would not have a similar constancy of pressure magnitude. The movement of the piston in the first direction 81 under the influence of the cam is, essentially, a fluid transfer motion which causes the fuel to flow from the first chamber 121 to the second chamber 122. It is not a pressurizing stroke which provides pressurized fuel to a device, such as a fuel injector. The use of the spring 80 to pressurize the fuel and cause it to flow to a device, such as a fuel injector, results in a relatively constant pressure magnitude influenced only by the compression of the spring, its spring constant, and the area over which this resulting spring force acts. Pumps which use a mechanical drive, such as a cam and cam follower system, during the pressurizing stroke do not provide the same relative constancy that is available with the present invention. The use of the flexible shaft 210 provides an additional advantage of allowing the pump and its associated cam device to be located away from the source of motive power.

Although the present invention has been described with particular specificity and illustrated to show preferred and alternative embodiments, it should be understood that other embodiments are also within its scope.

We claim:

1. A liquid pumping system, comprising:

an internal combustion engine having a crankshaft;

a power take off device connected in torque transmitting relation with said crankshaft;

a pump having a stationary portion and a movable portion; and a flexible shaft attached between said power take off device and said pump to transmit torque from said power take off device to move said movable portion of said pump relative to said stationary portion of said pump thereby to perform a refilling operation of the pump and not to perform a compression stroke of the pump, wherein:

said power take off device comprises a drive shaft connected in torque transmitting relation between said crankshaft and said flexible shaft.

2. The pumping system of claim 1, further comprising:

a gear system connected between said crankshaft and said drive shaft.

3. A liquid pumping system, comprising:

an internal combustion engine having a crankshaft;

a power take off device connected in torque transmitting relation with said crankshaft;

a pump having a stationary portion and a movable portion; and a flexible shaft attached between said power take off device and said pump to transmit torque from said power take off device to move said movable portion of said pump relative to said stationary portion of said pump thereby to perform a refilling operation of the pump and not to perform a compression stroke of the pump, wherein said movable portion is a piston having a central axis, a first surface and a second surface, and further comprising a seal disposed within said opening between said first and second surfaces, said seal having an axial thickness which is less than an axial distance between said first and second surfaces, a motive device, configured to be actuated by a drive shaft and to cause said piston to move in a first direction within said opening and parallel to said central axis;

a return device configured to cause said piston to move in a second direction within said opening and parallel to said central axis, whereby said second surface moves out of contact with said seal when said piston moves in said first direction and said first surface moves out of contact with said seal when said piston moves in said second direction;

a fuel reservoir;

an outlet port which is connected in fluid communication with said opening; and an inlet port connected in fluid communication with said opening and configured to permit fuel to flow bidirectionally between said fuel reservoir and said opening.

4. The pump of claim 3, wherein:

said motive device is a cam disposed in sliding contact with a cam follower surface attached to said piston; and said return device is a resilient member which is configured to oppose movement of said piston in said first direction and to urge said piston to move in said second direction.

5. The pump of claim 4, wherein:

said piston and said opening are shaped to define a first chamber and a second chamber when said piston is disposed within said opening, said seal being disposed between said first and second chambers;

said inlet port is connected in fluid communication with said first chamber;

liquid within said first chamber flows into said second chamber when said piston moves in said first direction;

liquid in said second chamber flows through said outlet port when said piston moves in said second direction; and liquid in said fuel reservoir flows into said first chamber through said inlet port when said piston moves in said second direction.

* * * * *